US007980043B2

(12) United States Patent
Moebus

(10) Patent No.: US 7,980,043 B2
(45) **Date of Patent: *Jul. 19, 2011**

(54) PANELS WITH COUPLING MEANS

(75) Inventor: Maik Moebus, Lampertswalde (DE)

(73) Assignee: Kronoplus Technical AG, Niederteufen (CH)

( * ) Notice: Subject to any disclaimer, the term of this patent is extended or adjusted under 35 U.S.C. 154(b) by 0 days.

This patent is subject to a terminal disclaimer.

(21) Appl. No.: 12/484,276

(22) Filed: Jun. 15, 2009

(65) Prior Publication Data

US 2009/0249733 A1 Oct. 8, 2009

Related U.S. Application Data

(63) Continuation of application No. 10/276,036, filed as application No. PCT/EP00/05252 on Jun. 7, 2000, now Pat. No. 7,603,826.

(30) Foreign Application Priority Data

May 16, 2000 (DE) ..... 200 08 708 U

(51) Int. Cl.
*E04B 2/00* (2006.01)

(52) U.S. Cl. ..... 52/588.1; 52/592.1; 52/589.1

(58) Field of Classification Search ..... 52/592.1, 52/586.2, 589.1, 592.4, 588.1
See application file for complete search history.

(56) References Cited

U.S. PATENT DOCUMENTS

| | | | | |
|---|---|---|---|---|
| 2,947,040 | A | 8/1960 | Schultz | |
| 3,694,983 | A | 10/1972 | Couquet | |
| 5,295,341 | A * | 3/1994 | Kajiwara | 52/586.2 |
| 6,006,486 | A * | 12/1999 | Moriau et al. | 52/589.1 |
| 6,101,778 | A | 8/2000 | Martensson | |
| 6,247,285 | B1 | 6/2001 | Moebus | |
| 6,446,405 | B1 | 9/2002 | Pervan | |
| 6,490,836 | B1 | 12/2002 | Moriau et al. | |
| 2002/0007609 | A1 | 1/2002 | Pervan | |
| 2003/0024200 | A1 | 2/2003 | Moriau et al. | |

FOREIGN PATENT DOCUMENTS

BE 557844 6/1957

(Continued)

OTHER PUBLICATIONS

Patent Abstract of Japan Publication No. 07300979 to Toshiyuki.*

(Continued)

*Primary Examiner* — Basil Katcheves

(74) *Attorney, Agent, or Firm* — Renner, Otto, Boisselle & Sklar, LLP

(57) ABSTRACT

The invention relates to panels comprising coupling means which permit the panels to be interconnected by form fit. A first panel comprises a projecting edge positioned laterally on its underside as the coupling element. A second panel comprises a projecting edge positioned laterally on its upper side as the coupling element. One of the aforementioned edges has a first projecting locking element which engages in a corresponding first cavity or recess of the other edge when the two panels are joined together. The panels comprise additional coupling elements which lock the panels by form fit in a vertical direction, in relation to the surface of said panels. The coupling elements are configured in such a way that one panel can be connected to the other panel by form fit, by lowering the former in relation to the latter. Two panels of the aforementioned type can be interconnected without adhesive in a particularly rapid manner.

13 Claims, 5 Drawing Sheets

FOREIGN PATENT DOCUMENTS

| | | |
|---|---|---|
| DE | 2502992 | 7/1976 |
| DE | 3343601 | 6/1985 |
| DE | 29922649 | 3/2000 |
| DE | 20000484 | 5/2000 |
| EP | 0855482 | 7/1998 |
| EP | 0698162 | 9/1998 |
| EP | 0906994 | 4/2003 |
| WO | 96/27719 | 9/1996 |
| WO | 96/27721 | 9/1996 |
| WO | 00/20706 | 4/2000 |

OTHER PUBLICATIONS

Patent Abstract of Japan Publication No. 07300979 to Toshiyuki, Nov. 14, 1995.*

International Search Report for corresponding application No. PCT/EP00/05252 completed Jan. 17, 2001.

* cited by examiner

PANELS WITH COUPLING MEANS

PRIOR APPLICATION DATA

This application is a continuation of U.S. patent application Ser. No. 10/276,036 filed Nov. 5, 2003, now U.S. Pat. No. 7,603,826 which is a national phase of International Application No. PCT/EP00/05252 filed Jun. 7, 2000, all of which are hereby incorporated by reference.

The invention relates to panels with coupling means for connection without adhesive and to a method for laying the panels.

A panel, for example known from the document EP 090 6994 A1, is generally an elongate thin board which can be connected laterally, in other words on the longitudinal and transverse sides to further panels, for example via grooves and tongues. Panels connected to one and other in this way are usually used as floor covering or as wall paneling.

A panel is produced according to the prior art inter alia by a short phase compression method, as follows. A carrier board is placed on a foil-like layer saturated with resin, called "counteracting paper". A further foil-like layer saturated with resin and provided with a decoration is laid thereon. A layer of this type is known as "decorative paper". A next corundum-containing and resin-containing foil-like layer is applied to the decorative layer. This layer is known as "overlay". The desired hardness of the surface of a panel is achieved by the overlay. The above-mentioned layer system is held together at the edges with grippers and conveyed into a press. The press substantially consists of two boards arranged parallel to another and heated to about 200° C. The layer system is laid on the lower of the two boards. The upper board is then lowered in such a way that the layer system is compressed. The resins melt owing to the heat supplied above the boards. The upper board is then raised. Grippers with suction cups are brought to above the compressed layer system and lowered. The suction cups are then placed on the layer system and adhere firmly by suction. With the aid of the suction cups adhering firmly by suction the layer system is raised and conveyed away from the press. Panels are cut to size from this layer system with corresponding devices, the panels generally being about 1,200 to 1,300 mm in length, 5 to 12 mm in thickness and about 200 mm in width. Finally, grooves and tongues are milled. Panels are connected to one another via the groove and tongue. They then form floor coverings or wall panellings.

The connected panels are joined together for example to form a floor covering which is known as laminate floor.

To be able to avoid gluing a plug-in profile for a panel is known from the document WO 96/27721 which firstly comprises tongues and grooves in known manner. Moreover each tongue on a top and/or bottom side comprises at least one continuous nose. Each groove is provided with flutes in such a way that the nose or noses arrive in the corresponding flute once two panels have been joined together. This produces an interlocking connection between two panels. The use of adhesive is not required to join panels into a floor or wall covering.

If one panel is connected with its longitudinal side in an offset manner to a longitudinal side of the next panel, it can be necessary or useful to be able to displace it laterally after the interlocking connection. A lateral displacement of this type is desired, for example, to thus obtain a smooth lateral edge. It is also desired according to the documents EP 0 698 162 B1 and EP 0 855 482 B1 to be able to push together two panels bordering one another with their transverse sides and connected by their longitudinal sides to a third panel to thus achieve a closed surface.

In the prior art as is known from the documents WO 96/27719 or WO 96/27721 the nose-flute-tongue-groove connection extends over the entire longitudinal side of two panels. Strong frictional forces have to be overcome to subsequently carry out a relative displacement parallel to a longitudinal side.

To avoid frictional forces of this type according to the document EP 0 698 162 B1 play (Δ) is provided between a locking groove and a locking surface on a locking element.

DE 33 43 601 C2 discloses floor coverings connected to one another without adhesive, two connecting edges of panels being locked by means of a tongue engaging in a recess.

A profiled web in the form of a flat profile lug comprises a locking element at its open end. The locking element is received by a locking groove on the bottom side of an adjacent panel.

The boards are joined at their longitudinal sides by rotation about the longitudinal edge. In one embodiment locking is also provided on the short transverse sides to thus avoid a drifting apart of the boards in the event of loading. However, this locking only acts in one direction parallel to the floor surface and perpendicular to the short connecting edge.

It is the object of the invention to provide panels which can be connected to one another, without adhesive, on all sides in a stable and quick manner.

The object is achieved with the aid of a panel with the features of the first claim. Advantageous configurations emerge from the sub-claims.

A panel laterally comprises mechanical coupling means in such a way that panels can be connected to one another without adhesive. A panel according to the claim comprises means on the longitudinal or transverse sides such that two panels can be connected to one another in an interlocking manner thereby. The joint or edge which is then formed by the two panels is called the connecting joint or connecting edge hereinafter. An interlocking connection in the context of the claim exists when two panels joined together to form a flat area can only be displaced parallel to the connecting joint, but not perpendicular thereto, without using force, owing to the interlocking fit within the plane. However, it is still possible to rotate a panel, for example, about the connecting joint and in this manner to release two panels from one another. In the event of this movement one panel leaves the above-mentioned plane. A displacement in which the plane is not left does not take place in the event of a rotary movement of this type.

As an alternative it may be possible to lift a first panel relative to the second and to release them from one another using force. Force must be used in the context of the invention when the second panel has to be held in its position to bring about an unlatching of coupling elements and therefore release.

At least one interlocking connection is preferably provided as follows. On its bottom side, a panel comprises a projecting lip or flank. The lip or flank comprises a first indentation for example in the form of a groove. The first indentation is openly accessible, when the panel lies with its bottom side on a floor or is leant on a wall. On its top side, a further panel comprises a projecting lip or flank. On the bottom side of this projecting lip or flank there projects a first locking element, for example in the form of a nose or tongue. The coupling means previously mentioned in this paragraph (projecting flanks and first indentation and first locking element) are coordinated with each other in such a way that the first locking element can be introduced into the first indentation in such a way that as a result a mechanical connection parallel to the surface of the panels and perpendicular to the joining edge is effected. The coupling elements previously mentioned in this paragraph (projecting flanks and first indentation and first locking element) comprise a second indentation and a second projecting locking element. The second locking element latches into the second indentation when the first locking element is introduced into the first indentation. The coupling elements are configured to be sufficiently elastic to allow latching. A mechanical connection of the panels perpendicular to the surface of the panels is brought about by latching. After latching, two panels in the context of the invention are connected to one another without adhesive.

The above-mentioned connection without adhesive can be provided in such a way that there remains small play approximately of a few 1/100 or a few 1/10 of millimetres between the coupling elements, in that two panels are mechanically connected to one another relatively loosely. The play will then become noticeable in the connecting joint. However, the coupling elements are preferably coordinated with one another in such a way that the panels are connected to one another without any play remaining.

To simplify the insertion of the first locking element into the first indentation, the first locking element tapers towards its open end and/or the indentation has a funnel-like inlet.

In a further advantageous configuration of the invention, the projecting flank or lip provided on the bottom side of a panel, has a bevel which is similar to a ramp. In addition or alternatively, a bevel enclosing an angle greater than 90° with the bottom side of the associated flank or lip is provided below the flank or lip, provided at the top side of a panel. Owing to the above-mentioned bevels connection of two panels is further simplified.

To produce the above-mentioned elasticity, the first locking element comprises at its open end one or more incisions or milled flutes. The first locking element can be compressed somewhat at its open end, thus enabling introduction of the second locking element into the second indentation.

The above-mentioned coupling elements are configured in such a way that the bottom side of a projecting lip or flank of a panel rests at least one point on the top side of a projecting lip or flank of a further panel when the two panels are joined together. This ensures inter alia a firm connection without adhesive between two panels. The bottom and top side should be wide in design in this context. It is sufficient when the support is provided by means of the first locking element and by means of the first indentation.

In an advantageous configuration of the invention gaps remain between the coupling elements of two panels connected together at the points not being used for the mechanical connection. This simplifies connection still further. Inaccuracies in the production of the coupling elements can moreover be more easily compensated.

In a further advantageous configuration of the invention, the first projecting locking element comprises the second projecting locking element at the side forming a recess together with the associated panel.

As can be inferred from one of the following embodiments, further coupling elements in the form of projecting locking elements may be provided which latch into an indentation in a further panel so as to create a mechanical locking perpendicular to the surface of the panels. The connection can be further strengthened in this manner.

With the aid of the coupling elements according to the claim panels can be connected more quickly in comparison to the prior art which requires a displacement of two panels already connected to a third panel. For this purpose panels either comprise coupling elements of the type according to the claim on all sides or coupling elements connected by a rotary movement are provided on one side. A lowering movement is sufficient in the first case to simultaneously connect a panel on two sides to already laid panels. In the second case the rotary movement is virtually combined with the lowering movement. Two panels are joined together, for example on the longitudinal sides, via a rotary movement about the common edge. At the same time it is possible to connect a third panel on the narrow side or transverse side to the panel which is rotated as the rotary movement is simultaneously a type of lowering movement relative to this third panel. Displacement as in the prior art is dispensed with. This simplifies and accelerates the process of mechanical connection.

Coupling elements which are connected to one another by a rotary movement are preferably configured as follows.

A panel comprises, for example at the longitudinal sides, at least one laterally milled groove formed by two flanks or legs. The one flank projects above the other, in other words is longer than the other. The two flanks are preferably rigid, in other words substantially not elastic. One flank is rigid in the context of the invention if, in contrast to the teaching according to document WO 97/47834, this cannot be elastically bent in such a way that joining by pushing together two panels in one plane is possible. At least one recess if provided in the longer flank.

A second panel laterally comprises a tongue which is inserted into the above-mentioned groove to connect two panels to one another. The tongue comprises at least one projecting nose on its bottom or top side which arrives in the above-mentioned recess of the flank when the two panels are joined. The nose then reaches the base of the recess.

The tongue is configured such that on one side (bottom or top side) it comprises, at least in the region of its open end, a spacing from the adjacent flank of the groove when the tongue has been introduced into the corresponding groove. Therefore, there remains a gap between the relevant bottom or top side of the tongue and the adjacent flank. This gap extends at least to the open end of the tongue, so the open end does not touch the flank. The tongue is in particular bevelled, so the tongue extends in this region like a point. The relevant bottom or top side is the side bordering the flank with the recess. Owing to this bevel or owing to the free space provided it becomes possible to release one panel from a further panel, without great application of force, by a rotary movement about the connecting joint, or conversely to connect two panels to one another owing to the rotary movement. The tongue is therefore moved into the corresponding groove of an adjacent panel owing to a rotary movement, without the flank with the recess having to be bent to a great extent.

A rotary movement of this type is known from the document EP 0 855 482 B1, but it is not known therefrom to provide a gap by the provision of, for example, the above-mentioned bevel in a tongue, to thus be able to avoid bending an adjacent elastic flank.

Owing to the geometry according to the invention it is possible to configure the flanks of the lateral groove in a panel to be rigid. Interlocking connection between two panels is then particularly stable.

The nose reaches to the base of the recess, to thus compensate for the tongue in the region of the bevel no longer bordering the flank as in the prior art. A contact face of this type is namely required so the one surface of a panel cannot be lowered owing to a loading relative to an adjacent panel surface.

With a further side, the nose contacts a lateral wall of the recess when two panels are joined. This is the side or wall, by which locking (parallel to the surface of the panels) is effected between two panels. This contact is necessary so the panels are firmly joined together. It can thus be ensured that the connecting joint between the two panels has no gap.

The recess in the flank of the groove exists in particular as a flute extending parallel to the adjacent connecting joint between two panels. A recess can, of course, also have other forms. For example the recess could be a slot into which the corresponding nose of a further panel can latch.

In one configuration of the invention a gap or play is provided between the side of the tongue comprising the beveling and the projecting flank. This further facilitates the joining of two panels. A gap may be provided as the nose contacts the base of the recess and adopts the function of the generally provided contact between tongue and groove. The gap or play between the tongue and the groove may be limited to a few hundredths of a millimetre, for example 3/100 mm as preferred lower limit.

A panel according to the claim therefore comprises means at the longitudinal and/or transverse sides such that two panels can be connected to one another in an interlocking manner thereby. An interlocking connection in the context of the claim exists when two panels joined together to form a flat area can only be displaced parallel to the connecting joint, but not perpendicular thereto, owing to the interlocking fit within the plane. However, it is still possible to lift a panel using force or to rotate it about a connecting joint and thus to release the panels from one another. During the rotary movement one panel leaves the above-mentioned plane and is simultaneously lifted relative to a lateral adjacent, laid panel. A displacement, in which the plane is not left, does not therefore take place in the case of a rotary movement of this type.

Figure 1:
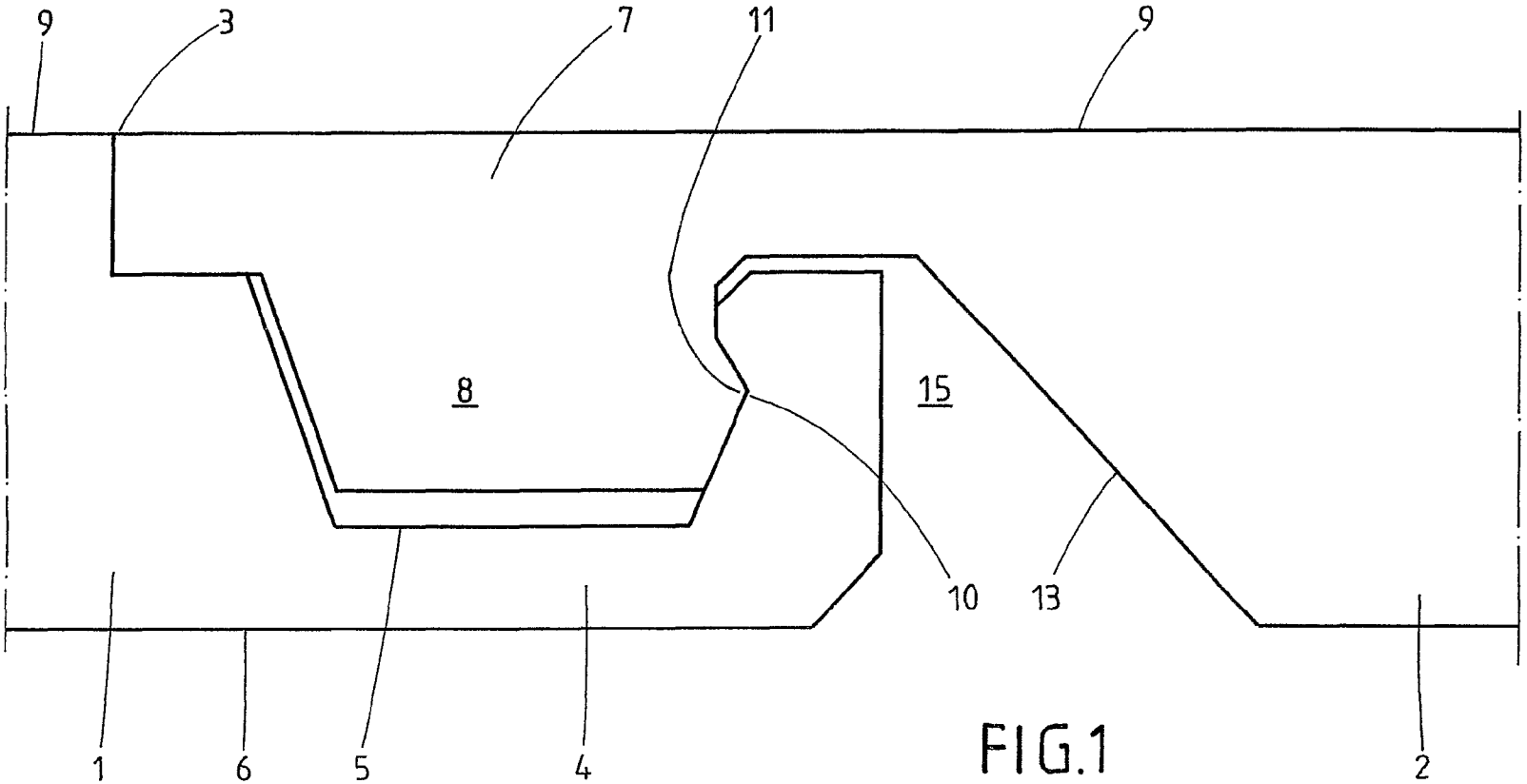
FIG. 1 is a cross-sectional view of panels coupled in accordance with the invention.

The invention will be described in more detail with the aid of the following drawings 1 to 5.

Panels 1 and 2 laterally comprise mechanical coupling means according to FIG. 1 to 5 such that panels 1, 2 and 3 can be connected to one another without adhesive. Each panel 1, 2 and 3 comprises means on the longitudinal or transverse sides, such that panels can be connected to one another in an interlocking manner thereby. The joint or edge 3 or 20 which is then formed by two panels is the connecting joint or connecting edge. The panels 1, 2 and 3 joined to form a flat area may be displaced at most parallel to the connecting joint 3 or 20 but not perpendicular thereto without the application of force, owing to the interlocking fit. In the event of parallel displacement relative to the connecting joint force has to be used if corresponding friction has to be overcome. This is the case in the examples shown. It is possible, according to FIG. 1 to 4, to lift a panel 2 relative to the panel 1, to thus release the panel 1 from the panel 2 using force. In the process, the interlocking connection is released. In the coupling elements according to FIG. 5, it is necessary to rotate a panel about the connecting joint to thus release the two panels 2 and 3 from one another. A displacement in which the plane formed by the panels 1, 2 and 3 is not left does not take place in the case of the lifting or rotary movement.

According to FIG. 1 to 4, the panel 1 on its transverse side and on its bottom side comprises a projecting lip or flank 4. The lip or flank 4 comprises a first indentation in the form of a groove 5. The first indentation 5 is openly accessible when the panel 1 rests with its bottom side 6 on a base or is fastened to a wall. The further panel 2 comprises at its top side a projecting lip or flank 7. At the bottom side of this projecting lip or flank there projects a first locking element 8 in the form of a tongue. The projecting flanks 4 and 7 and the first indentation 5 and the first locking element 8 are coordinated with each other in such a way that the first locking element 8 can be introduced into the first indentation 5 in such a way that a mechanical connection parallel to the surface 9 of the panels 1 and 2 and perpendicular to the connecting edge 3 is thus effected. The projecting flanks 4 and 7 and the first indentation 5 and the first locking element 8 comprise at least a second indentation 10 and a second projecting locking element 11. The second locking element 11 latches in the second indentation 10 when the first locking element 8 is introduced into the first indentation 5. These coupling elements are configured sufficiently elastically to allow introduction of the first locking element 8 into the first indentation 5 and latching of the second locking element 11 in the second indentation 10, without the coupling elements being damaged. A mechanical connection of the panels perpendicular to the surface 9 of the panels 1 and 2 is effected owing to the latching. After latching, the two panels 1 and 2 are connected to one another without adhesive in the context of the invention.

The connection without adhesive shown in FIG. 1 to 4 is such that no play remains between the coupling elements such that the two panels 1 and 2 are mechanically connected to one another relatively loosely. Play does not occur in the connecting joint 3. The coupling elements are therefore coordinated with one another in such a way that the panels 1 and 2 are firmly connected to one another in the context of the invention.

Figure 2:
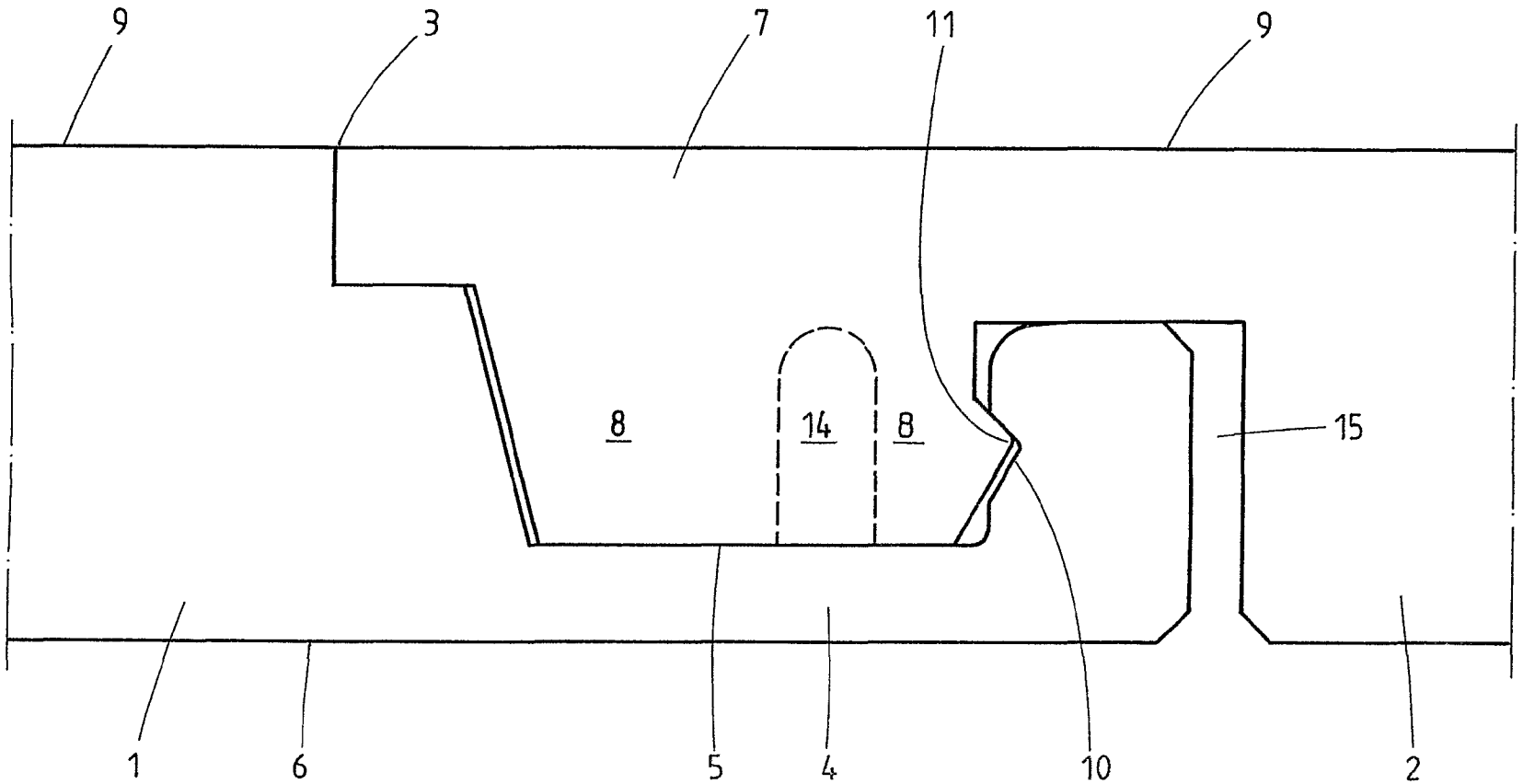
FIG. 2 is a cross-sectional view of another embodiment of panels coupled in accordance with the invention.

To simplify the insertion of the first locking element 8 into the first indentation 5, the first locking element 8 tapers, according to FIG. 1 to 4, toward its open end (pointed) and the first indentation 5 comprises a funnel-like inlet, in particular according to FIGS. 1 and 2.

Figure 3:
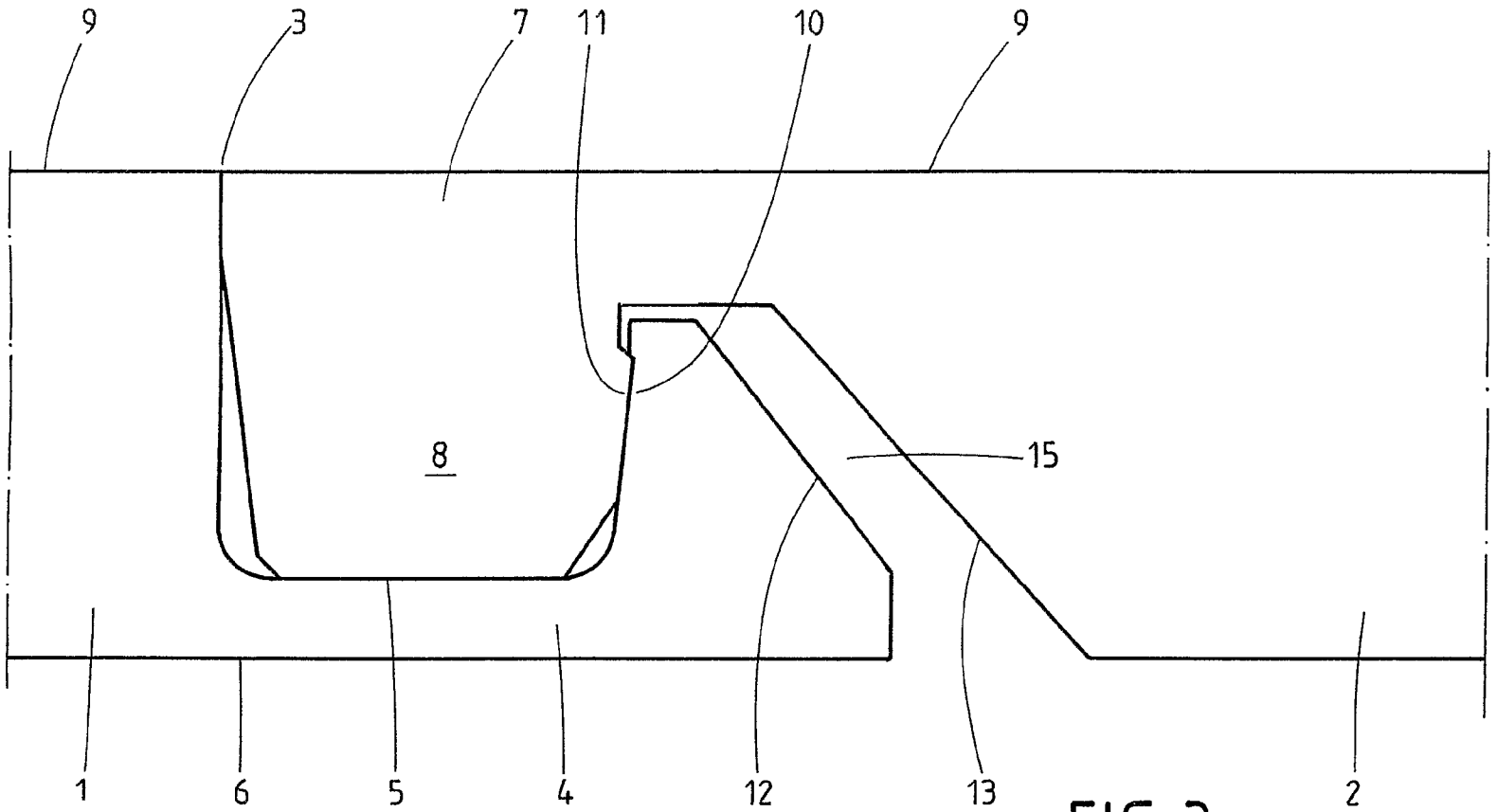
FIG. 3 is a cross-sectional view of still another embodiment of panels coupled in accordance with the invention.

According to FIG. 3, the projecting flank or lip 4 provided on the bottom side 6 of the panel 1 comprises a bevel 12 similar to a ramp. In addition or alternatively, there is a bevel 13 enclosing with the bottom side of the associated flank or lip 7 an angle which is greater than 90°, according to FIGS. 1, 3 and 4 below the flank or lip 7 provided on the top side of the panel 2. The connection of the two panels 1 and 2 is further simplified owing to the above-mentioned bevels 12 and 13.

Figure 4:
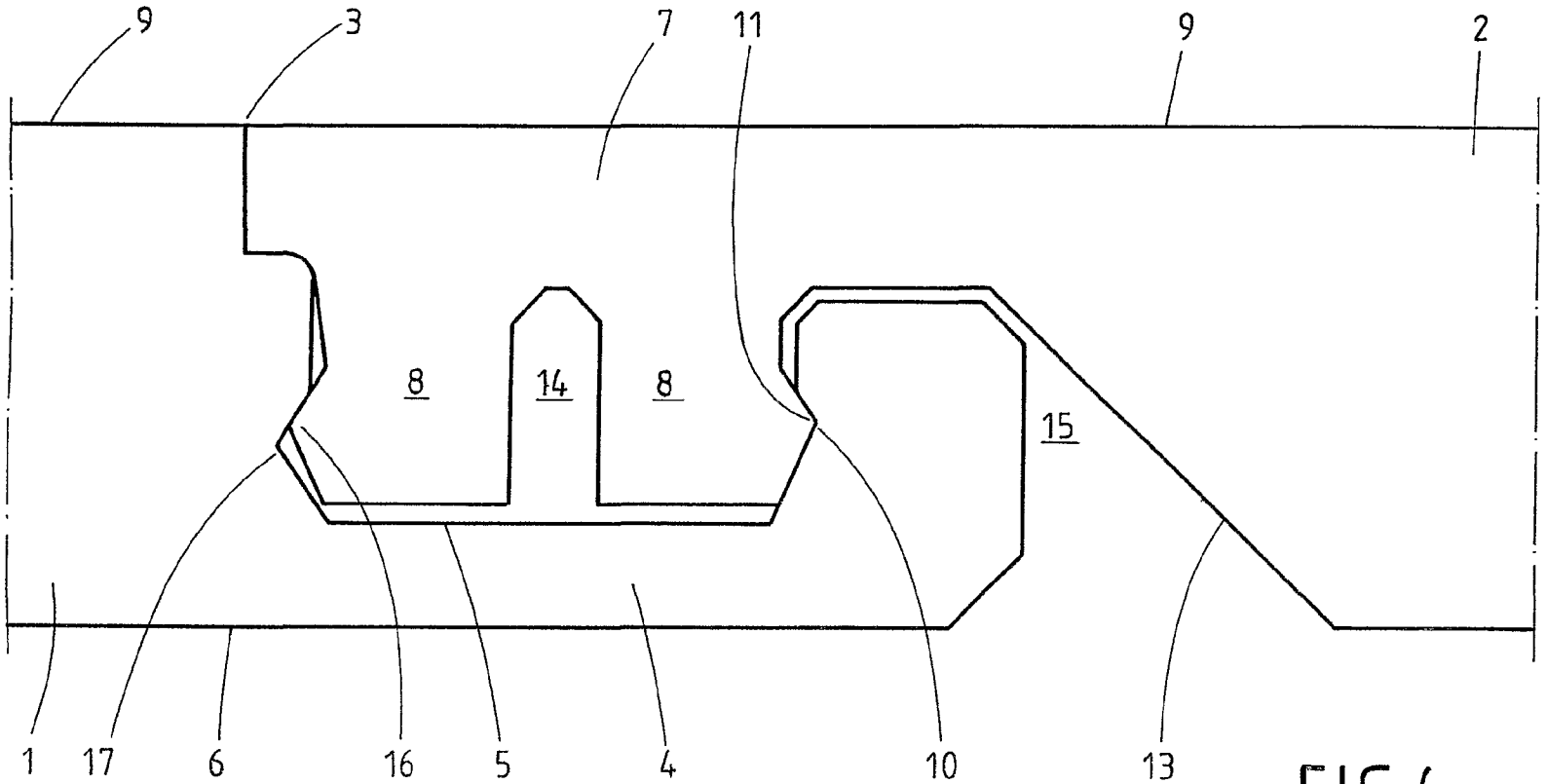
FIG. 4 is a cross-sectional view of yet another embodiment of panels coupled in accordance with the invention.

To bring about said desired elasticity in the coupling elements, the first locking element 8, according to FIGS. 2 and 4, on its open end comprises an incision 14. The first locking element 8 can be somewhat compressed at its open end, to thus introduce the second locking element 11 into the second indentation 10.

The coupling elements according to FIG. 1 to 4 are configured such that the bottom side of the projecting lip or flank 7 of the panel 2 rests, at least at one point, on the top side of the projecting lip or flank 4 of the panel 1 when the two panels are connected to one another. This ensures inter alia firm connection without adhesion between the two panels. It is sufficient when the support, as shown in FIG. 3, is brought about exclusively by means of the first locking element 8 and by means of the first indentation 8.

Between the coupling elements of the two connected panels 1 and 2 there remain, according to FIG. 1 to 4, gaps at the points not used for mechanical interlocking connection. This simplifies connection. Inaccuracies in the production of the coupling elements can be easily compensated. According to FIG. 1 to 4 the first projecting locking element 8 comprises the second projecting locking element 11 on the side forming a recess 15 together with the associated panel 2.

Additional coupling elements in the form of a projecting locking element 16 latching into a neighbouring indentation 17 in the panel 1 to thus provide a mechanical locking perpendicular to the surface of the panels are shown in FIG. 4. The interlocking connection can thus be further reinforced.

Figure 5:
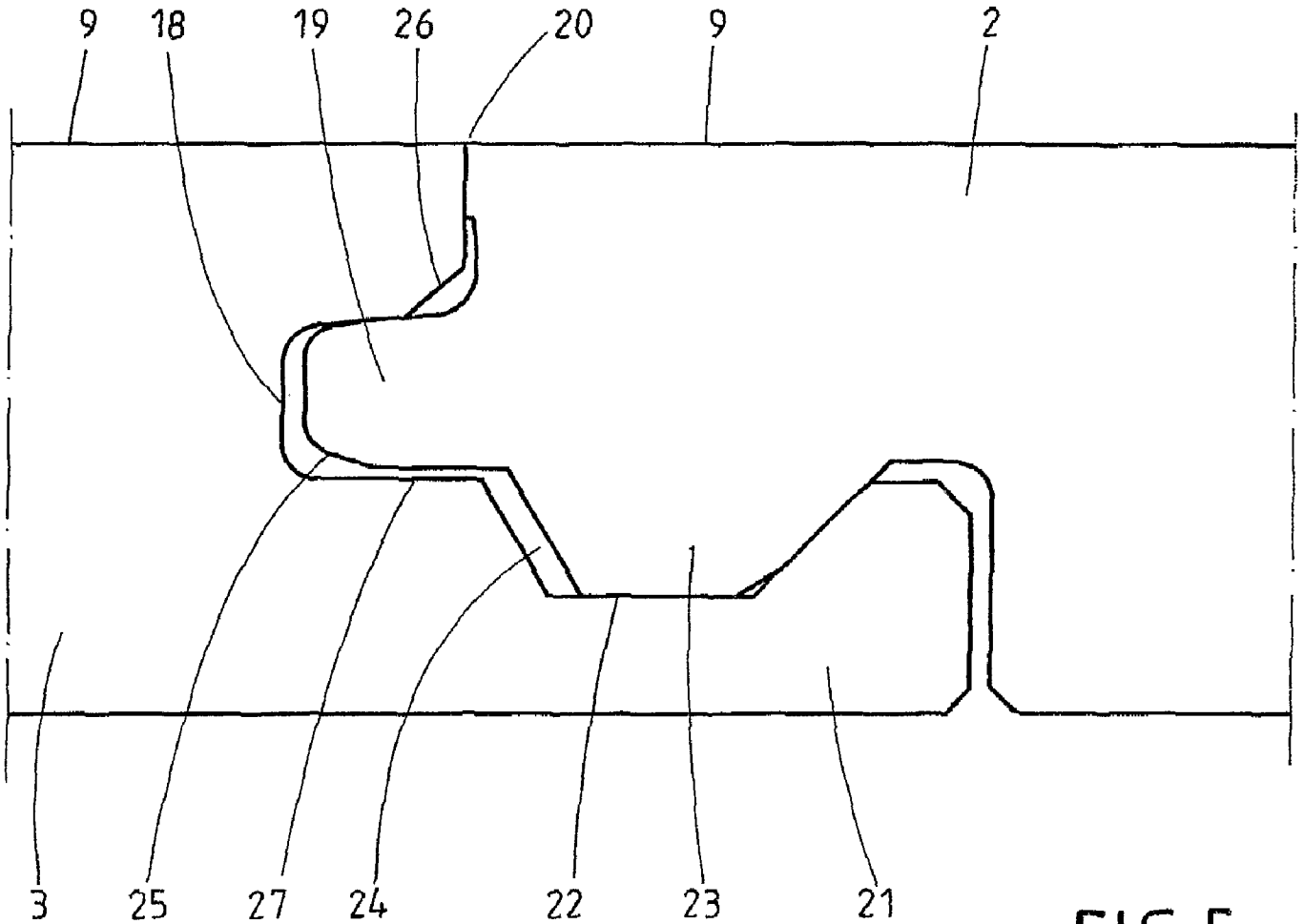
FIG. 5 is a cross-sectional view of a further embodiment of panels coupled in accordance with the invention.

With the aid of the coupling elements shown in FIG. 1 to 4, panels can be connected more quickly in comparison to the prior art which requires a displacement of two panels already connected to a third panel. For this purpose panels either comprise coupling elements, of the type shown in FIG. 1 to 4, on all sides or coupling elements, as shown in FIG. 5, are provided on one side (in particular on the longitudinal side) which are connected by a rotary movement. In the first case a lowering movement is sufficient to simultaneously connect one panel 2 on two sides to already laid panels. In the second case the rotary movement between two panels 2 and 3 is virtually combined with the lowering movement between two panels 1 and 2. Two panels 2 and 3 are connected to one another, for example on the longitudinal sides according to FIG. 5, via a rotary movement about the common edge 20.

At the same time it is possible to connect the panel 1 on the narrow side or transverse side to the panel 2 as the rotary movement is simultaneously a type of lowering movement relative to the panel 1. A displacement as in the prior art is dispensed with. This simplifies and accelerates the process of mechanical connection.

FIG. 5 shows a section through two panels 2 and 3 connected to one another in an interlocking manner in the context of the invention. Panel 3, on a longitudinal side, comprises a groove 18. A tongue 19 is provided on a longitudinal side of the panel 2. The tongue 19 has been rotated into the groove 18 and is therefore located in the groove 18. The connecting joint 20 was used during the rotation as the axis of rotation. The connecting joint 20 is the joint located between the two panels 2 and 3. The longitudinal side of the panel 3 comprises a projecting lower flank 21. This lower flank 21 is rigid on the long side in the context of the invention, as it is not possible to press this downward sufficiently elastically to be able to push the tongue 19 of the panel 2 into the groove 18 by a movement in one plane. A flute 22 has been milled from above substantially perpendicularly into the lower flank 21 as a recess. The flute 22 extends over the entire longitudinal side of the panel 3. Panel 2 comprises a nose or projecting locking element 23 below the tongue 19. FIG. 5 shows how a nose 23 projects into the flute 22. The position of the nose 23 is coordinated with the flute 22 in such a way that the panel 3 ends tightly with the panel 2 on the top side 9 of the panels. There is therefore no gap on the surface in the case of the connecting joint 20. If it is not necessary to ensure a closed surface 9, a gap 24 is provided between the nose 23 and the flute 22. Problems owing to manufacturing tolerances are thus avoided. Handling is also simplified in the joining of two panels. The tongue 19 comprises a bevel 25 on its bottom side. The tongue 19 is therefore pointed on this bottom side. The bevel 25 is provided to be able to turn the tongue into the groove 18 without disruption by a rotary movement, without the rigid leg 21 or the lower rigid flank 21 having to be noticeably bent downward. The end of the tongue 19 does not project completely into the groove 18, so a gap remains. Problems occurring due to manufacturing inaccuracies are avoided by providing this gap. The top side of the groove 18 opens to the outside into a bevel 26. Therefore a gap between the two panels 2 and 3 also remains at this point. Further space, required to rotate the tongue 19 into the groove 18, is provided owing to the provision of the bevel 26.

The nose 23 reaches to the base of the flute 22 and serves as a support. In particular for this reason a gap 27 may remain between the bottom side of the tongue 19 and the wall of the groove 18 located there below.

The invention claimed is:

1. Panels with coupling elements, allowing an interlocking form-fitting connection between the panels comprising first and second panels each provided with a coupling element on a first side such that the first panel and the second panel can be connected form-fittingly to a third panel by a rotary movement around a connecting joint, and wherein the first panel comprises on a second side, adjacent the first side, a laterally projecting flank on a top portion of the second side as an additional coupling element, and the second panel comprises on a third side, adjacent the first side, a laterally projecting flank on a bottom portion of the third side as an additional coupling element, and the projecting flank on the first panel comprises a first projecting locking element engaging in a corresponding first recess or indentation in the-other flank in the joined state of the panels, which projecting flanks of the panels comprise further coupling elements, locking the panels in an interlocking manner in the vertical direction relative to the surface of the panels, wherein the additional coupling elements are configured such that the first panel can be connected in an interlocking manner by a lowering relative to the second panel without a rotary movement around a connecting joint of said additional coupling elements.

2. Panels according to claim 1, wherein as coupling elements, configured such that one panel can be connected in an interlocking manner by lowering relative to the other panel, a second projecting locking element and a second indentation are provided.

3. Panels according to claim 2, wherein as coupling elements, configured such that one panel can be connected in an interlocking manner by lowering relative to the other panel, a third projecting locking element and a third indentation are provided.

4. Panels according to claim 1, comprising tapering at an open end of the first projecting locking element.

5. Panels according to claim 1, comprising a bevel at an open end of the flank attached to the bottom portion.

6. Panels according to claim 1, comprising an incision in the first projecting locking element, so the open end of the first projecting locking element can be compressed.

7. Panels according to claim 1, wherein the projecting flank on the top portion of the first panel rests on the projecting flank on the bottom portion of the second panel in the joined state.

8. Panels according to claim 1, wherein gaps between the coupling elements are provided in such a way that there remains no play between the panels in the connecting joint.

9. Panels according to claim 1, comprising a funnel-like aperture in wherein the first indentation has a tapered inlet.

10. Panels according to claim 1, wherein the recess formed is by a bevel.

11. Method for connecting panels, wherein a first panel is connected in an interlocking manner on a first side to a third panel by a rotary movement about a common connecting joint and in which the first panel is simultaneously connected at a second side, adjacent the first side, in an interlocking manner to a second panel by a lowering relative to the second panel without a rotary movement about a common connecting joint between the first and second panels, wherein the panels include coupling elements allowing an interlocking form-fitting connection between the panels, each panel provided with a coupling element on a first side such that the first panel and the second panel can be connected form-fittingly to the third panel by a rotary movement around the connecting joint, and wherein the first panel comprises on a second side, adjacent the first side, a laterally projecting flank on a top portion of the second side as an additional coupling element, and the second panel comprises on a third side, adjacent the first side, a laterally projecting flank on a bottom portion of the third side as an additional coupling element, and the projecting flank on the first panel comprises a first projecting locking element engaging in a corresponding first recess or indentation in the other flank in the joined state of the panels, which projecting flanks of the panels comprise further coupling elements, locking the panels in an interlocking manner in the vertical direction relative to the surface of the panels, wherein the additional coupling elements are configured such that the first panel can be connected in an interlocking manner by a lowering relative to the second panel without a rotary movement around the connecting joint of said additional coupling elements, the panels comprising a laterally applied groove on one panel and a laterally attached tongue in another panel, wherein the tongue engages in the groove in the joined state, one flank of the groove is longer than the other flank, the longer flank comprises a recess, the tongue comprises a projecting nose on a bottom or top side, the nose and the recess are arranged such that the nose can latch in the recess, and the side of the tongue comprising the nose comprises a recess so a gap remains between the side of the tongue comprising the nose and the longer flank of the groove in the joined state of the two panels owing to the recess formed, so the open end of the tongue does not touch the projecting flank when the two panels are joined.

12. Method according to claim 11, wherein the recess is in the form of a bevel.

13. A panel designed to be interlocked with another panel, the panel comprising two pairs of parallel side edges, one pair including first and second side edges having first and second coupling elements and the other pair including third and fourth side edges having third and fourth laterally projecting flanks, the first and second coupling elements being complementary for connecting the respective sides thereof with a rotary movement to adjacent sides of adjacent panels that respectively have like second and first coupling elements, and the third and fourth laterally projecting flanks being complementary for connecting the respective sides thereof by a lowering without a rotary movement around a connecting joint to adjacent sides of adjacent panels that respectively have like fourth and third projecting flanks, wherein the third laterally projecting flank comprises a projecting locking element configured to engage in a corresponding recess or indentation on the respective side of the adjacent panel and the fourth laterally projecting flank comprises a recess or indentation configured to be engaged by a projecting locking element on the respective side of the adjacent panel, wherein the projecting flanks on the third and fourth side edges include further coupling elements configured to lock the panel to the respective adjacent panels in an interlocking manner in a vertical direction relative to the surface of the panels, wherein the additional coupling elements are configured such that the third side edge can be connected to the adjacent panel in an interlocking manner by a lowering relative to the adjacent panel without a rotary movement around the connecting joint of said additional coupling element, the panel comprising a laterally applied groove on one side and a laterally attached tongue on the parallel side, wherein the tongue engages in a groove of the adjacent panel in the joined state, one flank of the groove is longer than an other flank, the longer flank comprises a recess, the tongue comprises a projecting nose on a bottom or top side, the nose is arranged such that the nose can latch in a corresponding recess of the adjacent panel, and the side of the tongue comprising the nose comprises a recess so a gap remains between the side of the tongue comprising the nose and a longer flank of the groove of the adjacent panel in the joined state of the two panels owing to the recess formed, so the open end of the tongue does not touch the projecting flank of the adjacent panel when the two panels are joined.

* * * * *